US006375212B1

(12) United States Patent
Hillairet et al.

(10) Patent No.: US 6,375,212 B1
(45) Date of Patent: Apr. 23, 2002

(54) RELEASE BINDING FOR SLIDEBOARD

(75) Inventors: Jean-Marc Hillairet; Juge Christophe, both of Nevers (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/558,725

(22) Filed: Apr. 26, 2000

(30) Foreign Application Priority Data

May 3, 1999 (FR) ..... 99 05734

(51) Int. Cl.[7] ..... A63C 9/086
(52) U.S. Cl. ..... 280/617; 280/624; 280/636
(58) Field of Search ..... 280/613, 611, 280/616, 617, 618, 620, 623, 624, 625, 626, 628, 629, 632, 634, 635, 14.21, 14.22, 14.24, 636

(56) References Cited

U.S. PATENT DOCUMENTS

| | | | | | |
|---|---|---|---|---|---|
| 3,905,613 | A | * | 9/1975 | Romeo | 280/623 |
| 3,931,980 | A | * | 1/1976 | Marker | 280/618 |
| 3,931,982 | A | * | 1/1976 | Kubelka | 280/616 |
| 4,113,276 | A | * | 9/1978 | Kirsch | 280/616 |
| 4,182,524 | A | * | 1/1980 | Beyl | 280/618 |
| 4,288,094 | A | * | 9/1981 | Svoboda | 280/623 |
| 4,505,493 | A | | 3/1985 | Gustavsson | |
| 4,741,550 | A | | 5/1988 | Dennis | |
| 5,020,823 | A | * | 6/1991 | Bogner | 280/634 |
| 5,116,074 | A | * | 5/1992 | Peyre | 280/618 |
| 5,697,631 | A | * | 12/1997 | Ratzek et al. | 280/613 |
| 5,743,550 | A | | 4/1998 | Frohwein | |
| 5,826,891 | A | * | 10/1998 | Albrecht | 280/623 |
| 5,871,226 | A | * | 2/1999 | Klubitschko et al. | 280/624 |
| 5,957,479 | A | * | 9/1999 | Bayer et al. | 280/624 |
| 6,017,042 | A | * | 1/2000 | Paris | 280/14.21 |
| 6,050,589 | A | * | 4/2000 | Couderc et al. | 280/624 |

FOREIGN PATENT DOCUMENTS

| | | |
|---|---|---|
| DE | 296 08 353 U | 7/1996 |
| FR | 2 483 793 | 12/1981 |
| FR | 2 740 350 | 4/1997 |

OTHER PUBLICATIONS

Preliminary Search Report in SN FR 9905734—France.

* cited by examiner

*Primary Examiner*—Brian L. Johnson
*Assistant Examiner*—Bridget Avery
(74) *Attorney, Agent, or Firm*—John Moetteli; Bugnion S.A.

(57) ABSTRACT

A binding comprising a first part (1) integral with a shoe which is fastened to a second part (2) integral with the slideboard. The second part comprises, at the front, a tilting jaw (5) coming to bear on the vertical bearing surfaces (4) and against a front bearing surface (3) of the first part and, at the rear, a stirrup (20) mounted pivotably about a vertical axis by means of a second stirrup (18) and tilting about a horizontal axis. The arms of this stirrup are in the form of a hook (33) coming to bear on a pair of lateral pegs (6) of the shoe. The jaw and the stirrup bear on slides (12, 26), between which compression springs are mounted. This binding preserves the independence of the torsion and forward-fall release assembly, and it is virtually insensitive to the changes to the exposed parts of the shoe during travel without a binding.

9 Claims, 4 Drawing Sheets

RELEASE BINDING FOR SLIDEBOARD

BACKGROUND OF THE INVENTION

The invention relates to a releasable binding for a slideboard, comprising a first part integral with a shoe and a second part which is intended to be fastened to the slideboard and in which the first part is retained at least approximately at its two ends on the second part by means of moveable components held in engagement with the first part under the action of at least one spring, so as to free the shoe in the event of a forward or backward fall and under torsion.

Such a binding is known from patent AT 315 040. The sole of the shoe is provided with a U-shaped metal piece having receptacles, in which are engaged retaining fingers, one of which is mounted slideably, against the action of a spring, in a housing fastened to the ski. A binding of the same type is described in the patent AT 317 738. The patent U.S. Pat. No. 3,957,280, the content of which is incorporated by reference, likewise describes a shoe of the same type, in which the two retaining fingers are mounted slideably against the action of one or two springs. In the bindings as described in the patent U.S. Pat. Nos. 3,834,723 and 4,191,395, the contents of which are incorporated by reference, the sliding locking fingers are mounted in the sole of the shoe and cooperate with surfaces formed respectively in two components and in one component fastened to the Ski. A solution of the same type as that described in patent U.S. Pat. No. 3,957,280 was readopted in the patent U.S. Pat. No. 4,245,409, the content of which is incorporated by reference. These designs make it possible to dispense completely with fitting the binding to the size of the shoes, that is to say to have a truly universal binding and to make it possible to reduce the number of components. By contrast, these bindings are not practical, since they have a major disadvantage: damage to the sensitive surfaces of the sole of the shoe, that is to say to the surfaces involved directly in releasing the binding in the event of a fall. These bindings nevertheless have a useful advantage which is the possibility of shaping the ends of the shoe very freely, in particular of dispensing with the front and rear footplates which are necessary for conventional ski bindings, and of rounding the lower face of the sole at its ends so as to make walking easier.

In order to overcome the disadvantages of shoes with an integrated binding according to the prior art mentioned above, it was proposed to produce a binding in three parts, namely a first part intended to be fastened to the slideboard, a second part integral with the shoe and a third part connecting the first and second parts, only the first and third parts being arranged so as to form a connection which is releasable in the event of a fall. The shoe may be conventional. Such bindings are described in the patents U.S. Pat. Nos. 3,918,732 and 4,191,395, the contents of which are incorporated by reference and in the patent FR2 659 565. These bindings are relatively bulky and are intended for shoes of the conventional type comprising a front footplate and a rear footplate for their bindings on the intermediate part. It is still necessary for a means for binding the shoe to the intermediate part to be fitted to the shoe size.

SUMMARY OF THE INVENTION

The object of the invention is to preserve the independence of the torsion and forward-fall release means which are found in the bindings with a thrust piece and with a heel piece, thus making it possible to control the releasing forces more effectively in each case.

The binding according to the invention is defined in that the first part, integral with the shoe, has, at the rear, a pair of lateral pegs, and in that the second part, integral with the slideboard, comprises, at the rear, a moveable component consisting of a stirrup mounted pivotably about an axis transverse to the binding and pivotably about a vertical axis, the arms of this stirrup coming into retention with the pegs of the first part and coming to bear on these pegs with ramps allowing the pegs to cause the stirrup to tilt counter to the action of the spring in the event of a forward fall.

According to one embodiment of the invention, the first part is rigid and integral with the sole and has, at the front, front vertical bearing surfaces and the second part, integral with the slideboard, comprising, at the front, a moveable component consisting of a jaw intended for bearing frontally and vertically on the bearing surfaces of the first part, this jaw being capable of tilting in a vertical plane and in a horizontal plane against the action of said spring.

In this case, the part integral with the sole of the shoe does not have a sensitive surface liable to disrupt the release of the binding.

Release under torsion is preferably controlled solely by the jaw. For this purpose, the stirrup bears on the spring, more specifically on a slide against which the spring reacts, with a part rounded in an arc of a circle and centered on a vertical pivotal axis of the stirrup, in such a way that the pivoting of the stirrup does not alter the compression of the spring.

The jaw is preferably articulated by means of a knuckle joint allowing it to tilt in all directions.

The stirrup is preferably mounted pivotably about a horizontal axis in a stirrup mounted pivotably about a central pivot, and the horizontal pivot axis of the retaining stirrup is located above its base with which the stirrup bears against its slide.

Shoe removal can be carried out by means of a shoe removal lever articulated in the rear of the stirrup and acting on the stirrup by means of a thrust piece in order to cause said stirrup to tilt against the action of the spring.

Forward-fall release is controlled by the stirrup which operates in the manner of a lever loaded by the pegs. This method of retention is insensitive to the surface quality of the pegs and of the parts of the hook-shaped stirrup.

The stirrup therefore provides no resistance to the release of the binding under torsion. The shoe first escapes from the jaw, and then the pegs escape from the stirrup, without subjecting the latter to tilting stress.

The first part integral with the shoe could be the sole itself. The pegs would be fastened to the sole, the front of which would have a conventional footplate retained by a stop piece of a conventional type.

BRIEF DESCRIPTION OF THE DRAWINGS

The accompanying drawings illustrate an embodiment of the binding according to the invention by way of example.

DETAILED DESCRIPTION OF THE PREFERRED EMBODIMENT(S)

Figure 1:
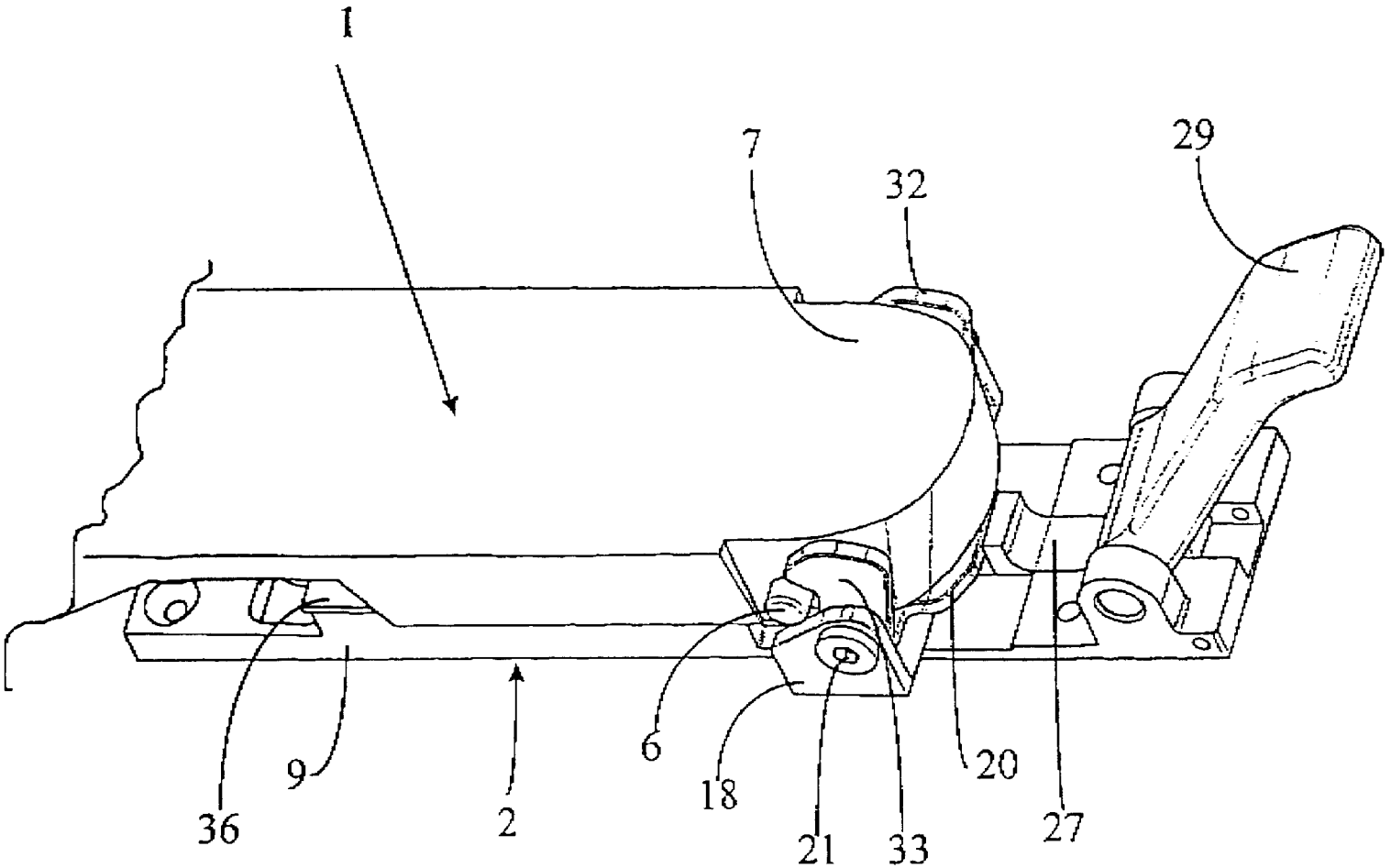
FIG. 1 is a perspective view of the sole of a shoe assembled together with the binding.
Figure 2:
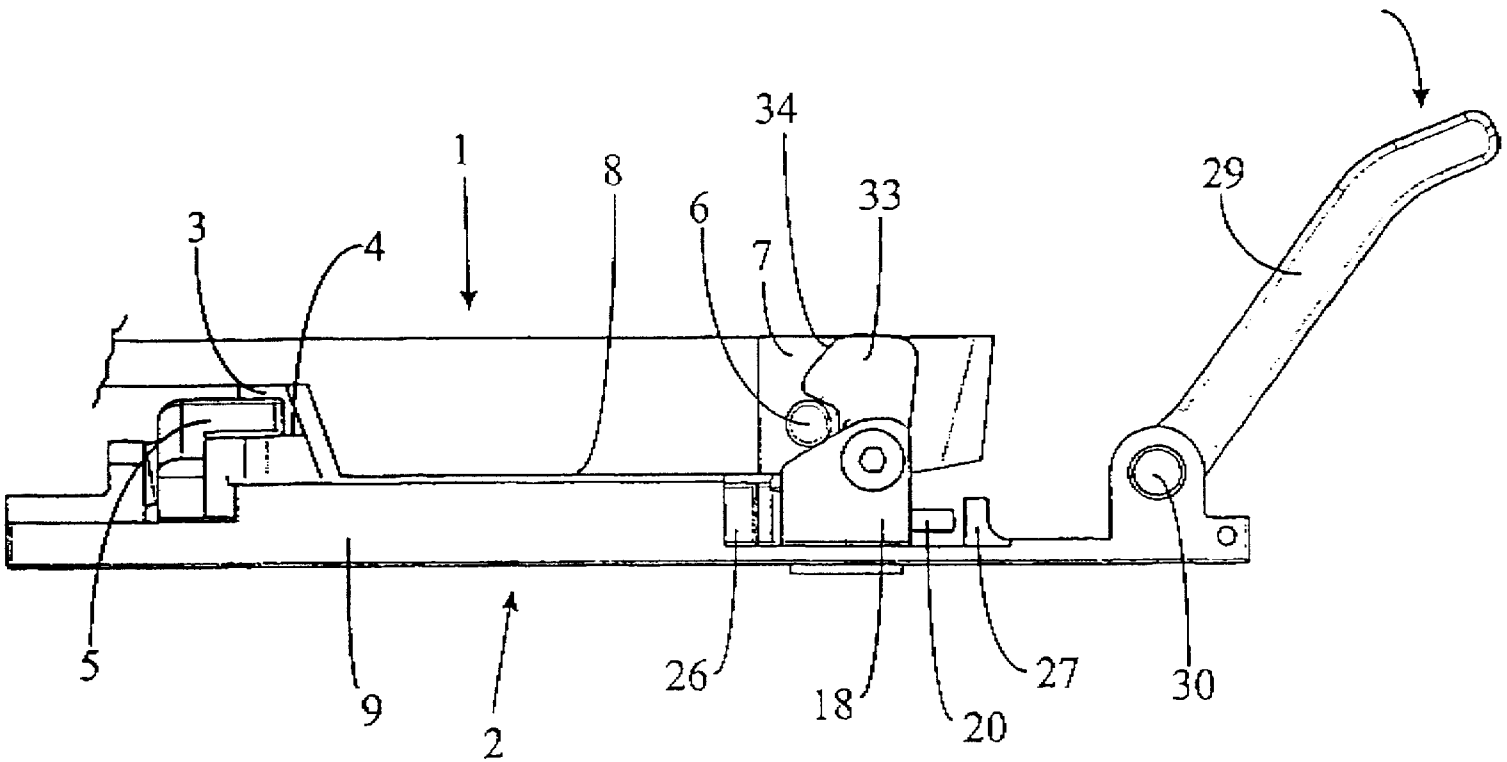
FIG. 2 is a side view of the two assembled parts of the binding.

The binding consists of a first part 1 integrated in a shoe sole and a second part 2 intended to be fastened to a slideboard.

The part 1 has, at the front, a front bearing surface 3 rounded in an arc of a circle about a vertical axis and, on each side of this front bearing surface, two horizontal plane bearing surfaces 4 serving as a vertical bearing surface for a jaw 5 of the binding, as will be described later with regard to the second part of the binding. At the rear, the first part 1 is provided with a pair of pegs 6 extending horizontally on each side of the part 1, that is to say on each side of the sole of the shoe. These pegs 6 are located in a narrowed zone 7 of the sole, so as virtually not to project laterally beyond the sides of the sole, Between the bearing surfaces 3, 4 and the pegs 6, the part 1 has a bearing surface 8 coming to bear on the second part 2 of the binding.

Figure 4:
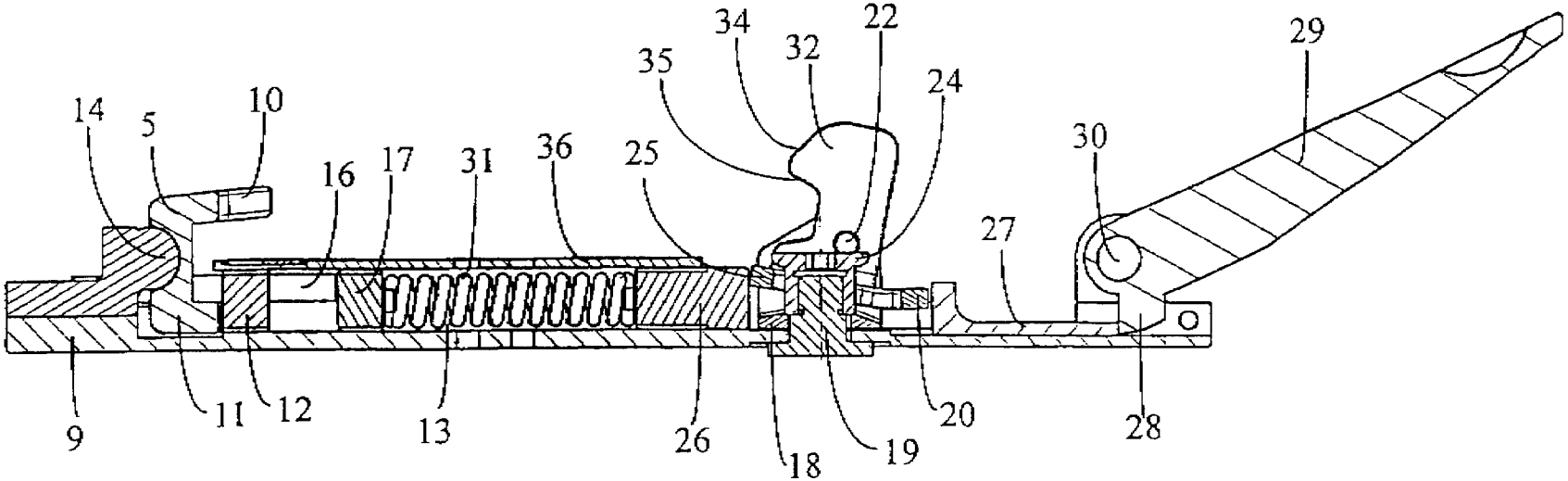
FIG. 4 is a view in axial section, in the vertical plane of symmetry, of the second binding part illustrated in FIG. 3.

The second part of the binding comprises a baseplate 9, on and in which are mounted the components of the this second part. At the front, the plate 9 carries the jaw 5 which, in section according to FIG. 4, has a C-shaped profile, the upper arm of which has a wide notch in the form of an open V 10, in which the rounded bearing surface 3 of the part 1 comes to bear, the jaw 5 furthermore coming to bear vertically on the bearing surfaces 4. The lower arm 11 of the jaw 5 bears on a slide 12 mounted slidably in a longitudinal slideway 13 of the base plate 9. The jaw 5 is mounted on a knuckle 14, so as to be capable of pivoting in all directions. The slide 12 has passing through it two parallel rods 15 and 16 which are threaded in the region of the slide 12 and are in engagement with said slide 12. The end of these threaded rods 15 and 16 bears against a second slide 17 likewise sliding in the slideway 13.

Figure 3:
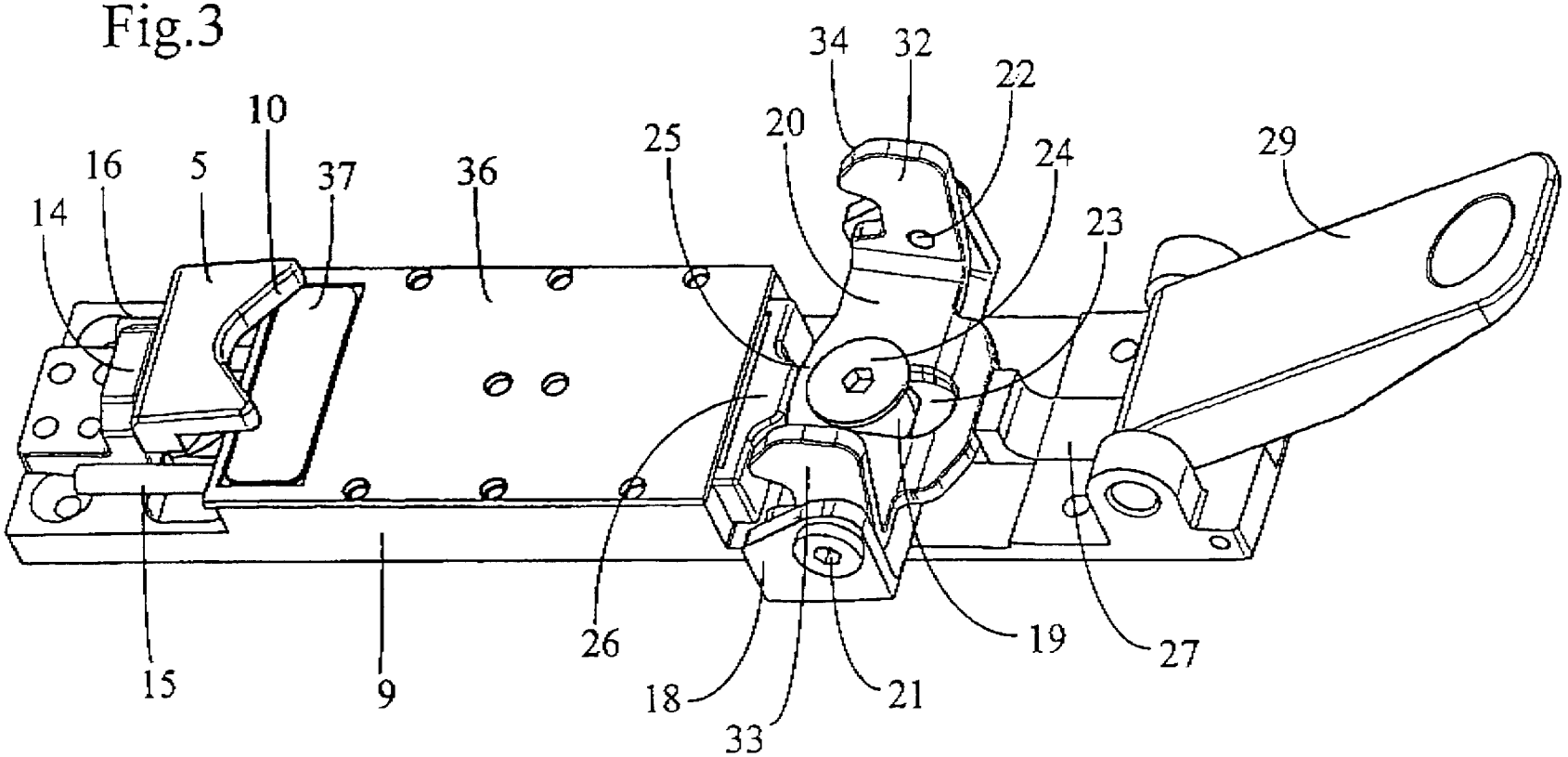
FIG. 3 is a perspective view of the second part of the binding, intended to be mounted on a slideboard.

In its rear region, the plate 9 carries a first stirrup 18 extending transversely to the plate 9 and mounted pivotably about a vertical axis, located in the plane of symmetry of the part 2 of the binding, by means of a pivot 19, on which the stirrup is retained vertically by means of a nut 24. In this first pivoting stirrup is mounted a stirrup 20 articulated in the stirrup 18 at two opposite points 21 and 22 of its arms, so as to be capable of tilting about a horizontal axis transverse to the plate 9 and located above the base of the stirrup. In its central part, the stirrup 20 has an oblong cutout 23 allowing it to tilt in spite of the presence of the nut 24. The stirrup 20 has, toward the front, a contour 25 which is rounded in an arc of a circle and is centered on an axis located at the rear of the axis of the pivot 19 and with which the stirrup bears against a slide 26 mounted in the slideway 13. The non-coincidence of the center of curvature of the contour 25 and of the axis of the pivot 19 is intended to ensure the recentering of the stirrups, as will be described later. In FIG. 3, the width of this slide 26 shows the width of the slides 12 and 17. At the rear, the stirrup 20 bears against an intermediate thrustpiece 27 which is mounted so as to be slideable longitudinally in a middle groove of the plate 9 and the other end of which bears against the nose 28 of a voluntary shoe removal lever 29 articulated on the plate 9 about a transverse horizontal axis 30.

Between the slides 17 and 26 is mounted a pair of parallel springs 31 operating under compression between the slides. The preload of the springs 31 can be altered by means of the rods 15 and 16, the rotation of which makes it possible to alter the position of the slide 17.

The arms 32 and 33 of the tilting stirrup 20 are shaped in the form of a hook, each having an upper ramp 34 and a lower ramp 35, In the position with the shoe attached, the arms 32 and 33 bear with their ramp 35 on the pegs 6 of the shoe under the thrust of the springs 31.

The slideway 13 is covered by a plate 36, on which the shoe comes to bear. Below the jaw 5, the plate 36 is provided with a pad 37 made of a material allowing the shoe to slide more easily.

To put on the binding, the user first introduces the bearing surfaces 4 under the jaw 5. During this introduction, the springs 31 allow the jaw 5 to be raised slightly in such a way that it comes to bear effectively on the bearing surfaces 4. The pegs 6 subsequently come into contact with the ramps 34 of the stirrup 20 and cause the latter to tilt backward, the arms 32 and 33 then being turned down onto the pegs 6.

In the event of a forward fall, the pegs 6 slide on the ramps 35 of the stirrup 20 and cause this stirrup to tilt backward, at the same time compressing the springs 31, then escape from the stirrup. The shoe can then be freed from the binding.

In the event of a fall accompanied by torsion, the front bearing surface 3 of the shoe causes the stirrup 5 to pivot laterally, the lower arm 11 of said stirrup pushing back the slide 12, at the same time compressing the springs 31. The stirrup 20 accompanies the shoe, at the same time pivoting together with the stirrup 18, with the compression of the springs being increased slightly due to the offset between the center of curvature of the rounding 25 and the axis of the pivot 19. After the stirrup has been freed, this slight increase in the compression of the springs has the effect of returning the stirrups into the initial position, that is to say of recentering them.

In the event of a backward fall, the bearing surfaces 4 cause the jaw 5 to tilt in a vertical plane thus allowing the bearing surfaces to escape from this jaw. During this movement, the pegs 6 pivot in the stirrup 20 and then escape from this stirrup at the front.

In order to remove the shoe voluntarily, it is sufficient to bear on the shoe removal lever 29 which causes the stirrup 20 to tilt backward by means of the thrustpiece 27.

The rounding 25 could be replaced by a simple flattening, that is to say a rounding of infinite radius, or by any other shape ensuring recentering of the stirrups as a result of the push of the slide 26.

According to another variant, the recentering of the stirrups 18 and 20 could be ensured by means of the push of the slide 26 on the stirrup 18. In this case, the rounding 25 of the stirrup 20 could be centered on the axis of the pivot 19 and the stirrup 18 would bear against the slide 26 with a rounded part, the center of which is located at the rear of the axis of the pivot 19 or with a flattening or with any other shape ensuring the recentering of the stirrups by means of the slide 26.

According to another alternative embodiment, the knuckle joint of the jaw 5 could be replaced by a bearing of the jaw 5 on two vertical ramps and one horizontal ramp in the manner of some jaws of front thrust pieces of conventional bindings with a thrust piece and heel piece.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A releasable binding for a slideboard, comprising a first part (1) integral with a shoe and a second part (2) which is intended to be fastened to the slideboard and in which the first part (1) is retained at least at a front end and a rear end on the second part by means of moveable components held in engagement with the first part under the action of at least one spring (31), so as to free the shoe in the event of a forward or rearward fall and under torsion, wherein the first part (1), integral with the shoe, has, at the rear, a pair of lateral pegs (6), and wherein the second part (2), integral with the slideboard, comprises, at the rear, a moveable component having a stirrup (20) mounted pivotably about an axis transverse to the binding and pivotably about a vertical axis, the stirrup having arms (32, 33) engaging with the pegs of the first part and coming to bear on these pegs with ramps allowing the pegs to cause the stirrup to tilt against the action of the spring in the event of a forward fall.

2. The binding as claimed in claim 1, wherein the stirrup (20) is mounted pivotably about a horizontal axis in a second stirrup (18) mounted pivotably on a central pivot (19) about a vertical axis.

3. The binding as claimed in claim 1, wherein the first part (1) is rigid and integral with the sole of the shoe, wherein this first part has, at the front, vertical (4) and front (3) bearing surfaces, and wherein the second part (2) comprises, at the front, a moveable component consisting of a jaw (5) intended for bearing frontally and vertically on the bearing surfaces of the first part, this jaw being capable of tilting in a vertical plane and in a horizontal plane counter to the action of the spring (31).

4. The binding as claimed in claim 2, wherein the stirrup (20) bears on a slide (26), pushed by the spring (31), with a part shaped so as to ensure the recentering of the stirrup, preferably a part (25) which is rounded in an arc of a circle and the center of which is located in the rear of the vertical pivot axis of the stirrup.

5. The binding as claimed in claim 4, wherein the horizontal pivot axis of the retaining stirrup (20) is located above a base with which the stirrup bears against the slide.

6. The binding as claimed in claim 3, wherein the jaw (5) is articulated by means of a knuckle joint (14).

7. The binding as claimed in one of claims 3 or 6, wherein the jaw (5) and the stirrup (20) bear on slides (12, 26), between which at least one compression spring (31) is mounted.

8. The binding as claimed in claim 3, wherein the stirrup (20) is mounted pivotably about a horizontal axis in a second stirrup (18) mounted pivotably on a central pivot (19) about a vertical axis and wherein the jaw (5) and the two stirrups (18, 20) bear on slides (12, 26), between which at least one spring (31) operating under compression is mounted, and wherein the stirrup (20) bears on its slide (26) with a part (25) which is rounded, the rounded part centered on the vertically pivot axis of the stirrup, and wherein the second stirrup (18) bears on the slide (26) with a part shaped so as to ensure a recentering of the stirrups after they have been freed, said part being shaped preferably in an arc of a circle, the center of which is located in the rear of the central pivot (19).

9. A binding as claimed in one of claims 1–6 or 8, wherein the second part comprises, in the rear of the stirrup (20), a shoe removal lever (29) acting on the stirrup by means of a thrust piece (27) counter to the action of the spring.

* * * * *